US010648104B2

(12) United States Patent
Muto et al.

(10) Patent No.: US 10,648,104 B2
(45) Date of Patent: May 12, 2020

(54) SYSTEM AND METHOD FOR FORMING NONWOVEN NANOFIBER MATERIAL

(71) Applicants: Keiko Muto, Torrance, CA (US); Mayuki Yanagawa, Torrance, CA (US)

(72) Inventors: Keiko Muto, Torrance, CA (US); Mayuki Yanagawa, Torrance, CA (US)

( * ) Notice: Subject to any disclaimer, the term of this patent is extended or adjusted under 35 U.S.C. 154(b) by 274 days.

(21) Appl. No.: 15/472,151

(22) Filed: Mar. 28, 2017

(65) Prior Publication Data

US 2018/0282903 A1 Oct. 4, 2018

(51) Int. Cl.

| | |
|---|---|
| ***D01D 5/098*** | (2006.01) |
| ***D01D 5/253*** | (2006.01) |
| ***D01D 4/02*** | (2006.01) |

(52) U.S. Cl.

CPC ..... *D01D 5/0985* (2013.01); *D01D 4/025* (2013.01); *D01D 5/253* (2013.01)

(58) Field of Classification Search

CPC ..... D01D 5/098; D01D 5/0985; D01D 5/253; D01D 4/025; D01D 4/02

See application file for complete search history.

(56) References Cited

U.S. PATENT DOCUMENTS 3,841,953 A * 10/1974 Lohkamp ..... D01D 5/0985 156/181
4,185,981 A * 1/1980 Ohsato ..... C03B 37/06 264/12
6,800,226 B1 * 10/2004 Gerking ..... D01D 4/025 264/40.3

* cited by examiner

*Primary Examiner* — Michael P Wieczorek

(74) *Attorney, Agent, or Firm* — Buchalter, a professional corp.; Kari L. Barnes

(57) ABSTRACT

A system and method for forming non-woven fibers includes an extruder for melting a substance, a nozzle on an end of the extruder for outputting the melted substance, and a gas source in fluid communication with the nozzle. The nozzle may be configured to output the substance in a melted form at atmospheric pressure proximate an output of the gas source. The system may be configured to output a gas stream at lower temperature.

7 Claims, 2 Drawing Sheets

SYSTEM AND METHOD FOR FORMING NONWOVEN NANOFIBER MATERIAL

BACKGROUND

Non-woven fiber processing methods may include such examples as electrospinning and melt blowing. Electrospinning involves applying a sufficiently high voltage to a liquid droplet expelled under pressure from a spinning tip. As the spun liquid dries, the charged substance is elongated by electrostatic repulsion as it travels through the air and dries and eventually deposited on a grounded collector. Melt blowing involves extruding a polymer melt from a small nozzle surrounded by high speed gas. The blowing elongates the fibers and randomly deposits the fibers in a nonwoven sheet.

Electrospinning cannot always achieve the smaller fiber diameters, especially for high viscosity polymer melts. Therefore, lower molecular weight polymers are usually required to achieve lower fiber sizes. Lower novel sizes must also be used to achieve the lower diameter fiber sizes, which greatly impede the production of such fibers on any large scale. The electrospinning technique is inherently slow and solvent intensive. Moreover, the available polymers are limited. Melt blowing processes generally achieve microfiber sizes in the diameter range of 2-4 μm. Attempts at smaller fiber sizes have been attempted. However, production is similarly limited and not scalable to larger production quantities or not available across different molecular weight polymers.

Examples of systems for producing nonwoven fibers can be found in, for example, U.S. Pat. No. 3,849,241, issued Nov. 19, 1974; USPN 2005/0053782, published Mar. 10, 2005; and US 2017/0016146, published Jan. 19, 2017, each of which is incorporated in its entirety herein.

SUMMARY

Exemplary embodiments described herein include systems and methods for forming non-woven, reduced diameter, polymer fibers. For example, systems may include a mechanism for outputting a melted substance into a gas stream. The output of the melted substance may be at approximately atmospheric pressure, such that it may not be self-propelled into a gas stream. The system may be configured such that the melted polymer is received into the high speed gas stream by aerodynamic lifting/pulling forces and/or gravity forces. The melted substance may be positioned in the gas stream through the influence of gravity with an aperture for the melted substance positioned gravitationally above the gas output. Exemplary embodiments may include a non-heated airstream, such that a temperature of the gas stream may be under 200° C.

DRAWINGS

DESCRIPTION

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Exemplary embodiments described herein include systems and methods for forming non-woven, reduced diameter, polymer fibers. The reduced diameter fiber may be on the order of 1 nanometer to 1 micrometer, or any value or range therein. Exemplary embodiments include an output end in which a melted polymer is directly sucked into a high speed gas stream by aerodynamic lifting forces generated by the high speed gas stream. For example, a melted polymer may be gravity dropped into a gas stream. Embodiments may therefore include a non-pressurized flow of polymer into a gas stream. Exemplary embodiments include non-heated airstreams, such that a temperature of the gas stream may be under 200° C.

Figure 1:
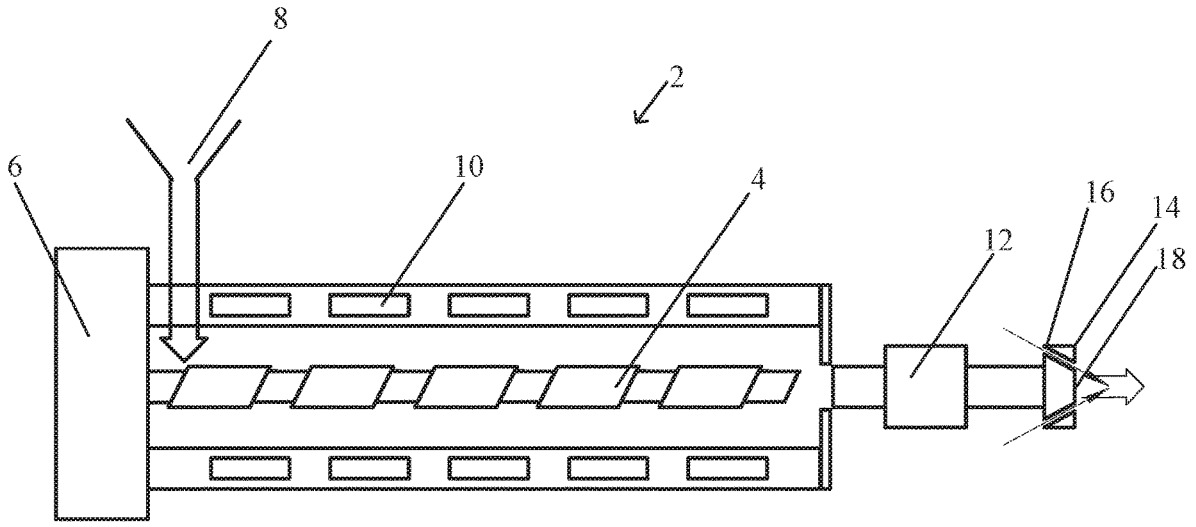
FIG. 1 illustrates an exemplary cross section of a system according to embodiments described herein.

FIG. 1 illustrates an exemplary embodiment of a melt blown assembly 2 according to embodiments described herein. The assembly may include an extruder having a central bore configured to transport the polymer from one end region 8 to an opposing end region 18. A force is imposed on the polymer to transport it along the bore. As seen in FIG. 1, a screw-type extruder 4 is used. However, any drive mechanism to move the polymer from an inlet to an outlet is within the scope of the instant description. The screw-type extruder 4 includes helical or spiral shaped fins defining a screw structure through the central bore. Rotation of the screw pushes the polymer against the fins and moves the polymer along the central bore. The extruder may also include a heater 10 to melt the polymer as it is moved along the central bore. As shown, the heaters 10 may be in an exterior wall of the extruder. The heaters may be positioned anywhere to transfer thermal energy to the polymer to melt the polymer. The heaters 10 may also or alternatively be in the screw, around an exterior surface of the extruder external wall, within the extruder wall, within the extruder central bore, at the resin inlet, within the nozzle, around the nozzle, or any combination thereof. The system may have a motor 6 or other driver for controlling the drive mechanism of the extruder by its driver force and/or gravity force. In the case of FIG. 1, the motor 6 turns the screw in the central bore. The system may also include a pump 12 for controlling the polymer flow, including pressure and speed of the polymer. At the end of the extruder, a nozzle 14 has an opening 18 for a polymer flow. The nozzle 14 or other component approximate the polymer opening may also include passages 16 for a gas flow. The nozzle is configured to output a melted polymer at a distance to effectively receive the melted polymer to the high speed gas stream by aerodynamic lifting/pulling forces and/or gravity forces.

In an exemplary embodiment, the position of the passages for the polymer and gas flow may be repositioned. For example, the gas flow may be a central opening, while the polymer openings may be above, below, around, or otherwise adjacent the central opening. The gas flow opening may be on a single side of the polymer opening or may be on opposing sides. A plurality of gas flow openings and/or polymer openings may be used in different combinations as described herein.

Exemplary embodiments may also use different extruder systems. For example, a pot type extruder may be used. In this case, the extruder may have a cavity for melting a substance. Typically, the substance is a plastic, such as the polymer discussed herein. However, other substances may also be used in place of or in combination thereof, such as metals, glass, etc. The cavity includes a heater to boil the plastic or otherwise liquefy the substance. The liquefied substance may then be extruded from a bottom portion of the cavity. Embodiments described herein, may include a gas stream outlet directed across the extruder plastic (or substance) outlet direction if the plastic outlet is on a bottom surface of the extruder.

In conventional melt blowing systems, the polymer is heated and expelled from a very tiny hole and/or tube of the nozzle at high pressure such that it is ejected into an air stream. The air stream itself is also heated. Conventionally, compressed air for blowing the polymer was first routed through an electric heater, and then fed by a hose to the air outlet aperture of the nozzle. For example, lower temperature systems may use 250-280° C. temperatures of air flow and 240° C. die temperatures, while high temperature systems may be upwards of 650° C. or more air flows. The heated airstream was believed to be required to maintain the polymer in a melt state for as long as possible in order to let the air stream elongate the liquid and create thinner fibers. The heated airstream was also believed to cause volume expansion to stretch the polymer. The polymer was also conventionally ejected into the airstream under pressure, such that it entered the air stream under its own momentum and penetrates to a central portion of the airstream. The heated polymer conventionally had to enter the center of the airstream in order to not freeze or solidify too quickly by the heat transfer at the margins of the airstream. Finally, in order to achieve finer fiber diameters, it was believed that the output aperture of the polymer nozzle had to be reduced. The smaller initial size was believed to result in a smaller output diameter as the polymer did not have to stretch or extend as far in order to obtain the reduced dimension. However, such restriction greatly hindered the flow rates. Therefore, it is conventionally understood that lower flow rates are required to achieve lower fiber diameters.

Exemplary embodiments described herein include an extruder including a polymer resin inlet, a drive mechanism for moving the polymer through the extruder and a power source to run the drive mechanism, and may also include a heating mechanism to melt the polymer resin within the extruder in the case of the thermal melting type extruder. The terminal end of the extruder may include a nozzle. The nozzle does not require any specific configuration or geometry and is not intended to be limited to nozzles of any specific application. Therefore, the nozzle does not have to have a tapered or reduced diameter, either on an interior bore or an exterior profile. The nozzle is simply a terminal end of the system in which a gas flow and a polymer flow exit the system. The nozzle may therefore include one or more apertures for a polymer flow and one or more apertures for a gas flow. The one or more apertures for a polymer flow may be in fluid communication with the extruder, while one or more apertures for a gas flow may be in fluid communication with a pressurized gas source.

In an exemplary embodiment, the polymer is not expelled from the system under excess pressure. For example, the polymer may exit the polymer aperture of the nozzle at approximately atmospheric pressure. Therefore, the output polymer is not ejected into the gas stream. In an exemplary embodiment, the polymer may be gravity fed into the gas stream. In an exemplary embodiment, the gas stream creates a suction force around the gas stream, thereby drawing the polymer output into the gas stream. Therefore, exemplary embodiment include configurations in which the polymer aperture is positioned sufficiently close to the gas aperture and/or where the polymer aperture is positioned over the gas aperture.

Figure 2:
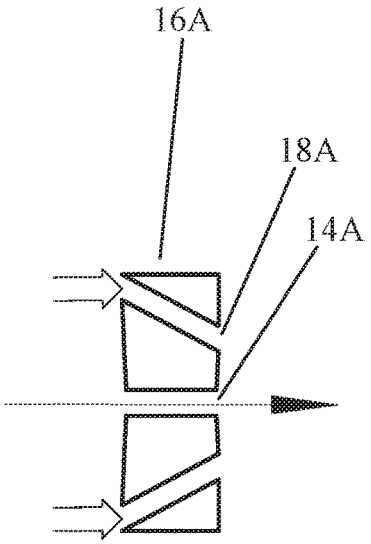
FIG. 2 illustrates an exemplary cross section of a component part according to embodiments described herein.
Figure 3:
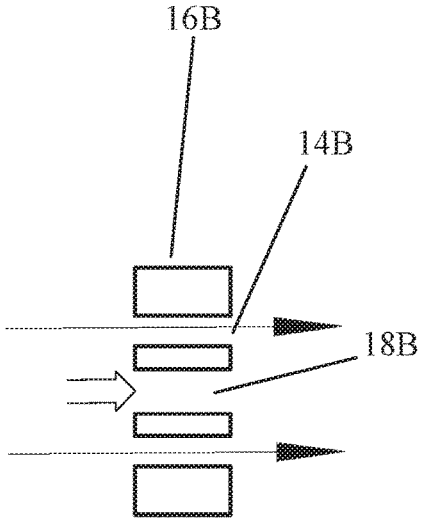
FIG. 3 illustrates an exemplary cross section of a component part according to embodiments described herein.
Figure 4:
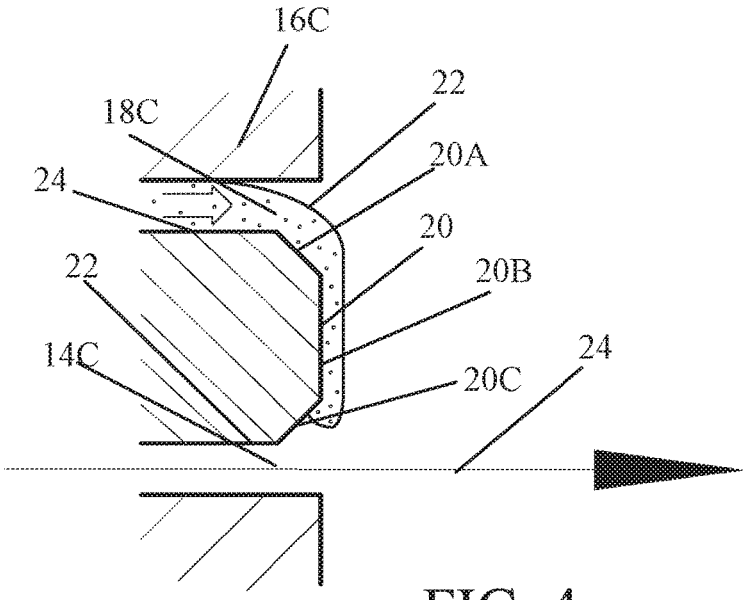
FIG. 4 illustrates an exemplary cross section of a component part according to embodiments described herein.

FIGS. 2-4 illustrate exemplary cross sections of nozzles 16A, 16B, 16C according to embodiments described herein. The exemplary nozzle may include one or more gas output apertures 14A, 14B, 14C, and one or more polymer output apertures 18A, 18B, 18C. As shown in FIG. 2, the polymer apertures 18A and gas output apertures 14A are swapped, such that the plurality of polymer apertures are around a gas output aperture. Also as shown in FIG. 2, the passages through the nozzle to the gas output aperture and the polymer output aperture may be angled, such that the output direction of the polymer is angled with respect to the output direction of the gas. As shown in FIG. 2, the polymer stream is angled toward the gas aperture, however, the gas aperture may alternatively or in addition thereto be angled toward the polymer aperture. As shown in FIG. 3, the respective apertures may be generally aligned such that the output streams are parallel. As shown, the apertures are orthogonal to the nozzle face.

In an exemplary embodiment, the polymer 22 exits the polymer output aperture 18C at approximately atmospheric pressure. Therefore, the polymer may not be ejected from the nozzle terminal end on its own. The polymer may flow through the polymer aperture defined by luminal wall 24. Once at the aperture 18C, the polymer may flow over a surface 20 between the polymer aperture 18C and gas aperture 14C. Once the polymer is adjacent the gas aperture 14C, the polymer 22 may gravity flow into the gas stream 24 and/or may be drawn into the gas stream by the suction forces created by the gas stream expulsion under pressure. Once captured in the gas stream 24, the polymer 22 is elongated to form fibers.

Exemplary embodiments include a surface of the nozzle between the polymer aperture and the gas aperture, referred to herein as the transition surface. The transition surface may be vertical, slanted with a vertical component, curved, contoured, planar, stepwise planar, or otherwise configured such that the polymer flows from the polymer aperture over the surface and toward the gas stream at the gas aperture. The transition surface preferably has a dimension in the vertical direction (along the gravity vector) such that gravity may assist with the transport of the liquid polymer from the polymer aperture to the gas aperture. The transition surface may define a perimeter of the gas aperture, such that the surface is continuous between the polymer aperture and the gas aperture. The transition surface may also be separated from a perimeter of the gas aperture, such that the polymer may be out of contact with the surface before entering the gas stream exiting the gas aperture.

An exemplary transition surface may include step-wise linear surfaces from the polymer aperture to the gas aperture. For example, each of the passages of the gas stream and polymer streams may define a bore of constant and/or variable cross-sectional dimension. At one of the apertures, a first linear surface may intersect the surface defining the bore internal surface. A second linear surface may intersect the first linear surface, and a third linear surface may intersect the second linear surface. The third linear surface may intersect the internal bore of the other of the apertures. Any combination of surfaces, such as a first, second, third, fourth, fifth, and so on surfaces, may sequentially linearly intersect between an internal bore surface of the polymer aperture to the internal bore surface of the gas aperture.

In an exemplary embodiment, one of the linear surfaces is oriented vertically. In an exemplary embodiment, one of the linear surfaces includes a vertically oriented vector component, but is angled with respect to vertical. The angled linear surface may be orientated such that a lower (in relation to vertical and up being higher) portion of the linear surface is away from the polymer output aperture and the higher portion is nearer the polymer output aperture. The higher portion of the angled linear surface may be adjacent the polymer output aperture. As described more fully below, the aperture may be of various sizes and shapes, and therefore, the corresponding surfaces between these apertures may similarly vary. It is understood that the reference to linear surfaces is intended to indicate a linear portion of the surface, such as taken in cross section. The linear portion may curve in a second dimension and still be considered a linear surface. For example, conical and cylindrical surfaces are considered linear as used herein, as they include a linear portion when seen in cross-section.

For example, the polymer aperture may be circular (or other geometric or non-geometric shape as described herein) and a first linear surface may circumferentially surround the aperture and define a perimeter of the aperture. The first linear surface may define a truncated cone, such that the linear surface creates an outward taper to increase an internal cross sectional diameter at the polymer bore to an opposing end of the linear surface. The first linear surface may fully or partially surround the polymer aperture. The first linear surface may intersect a second linear surface that is approximately vertical. The second linear surface may define a front face or terminal end of the nozzle. The gas aperture may similarly be circular and a third linear surface may circumferentially surround the aperture and define a perimeter of the aperture. The third linear surface may define a truncated cone, such that the linear surface creates an outward taper to increase an internal cross sectional diameter at the gas bore to an opposing end of the third linear surface. The third linear surface may fully or partially surround the polymer aperture. The third linear surface may intersect the second linear surface.

In an exemplary embodiment, the first and third surfaces may be adjacent each other such that the first and third surfaces intersect. In this case, there may be a portion between the first and third surfaces in which the second surface does not intervene. The first and third surfaces may define a cusp at the intersection of the surfaces. The second surface may be removed completely, and only the first and third surfaces transition between the polymer outlet aperture and the gas outlet aperture.

In an exemplary embodiment, the first, second, and third surfaces may smoothly transition from one to another, such that they do not create a step-wise transition but a smooth, continuous transition. In this case, the surfaces may be curved along their length or curved along a transition segment between linear portions.

In an exemplary embodiment, a single continuous surface may transition between the polymer outlet aperture and the gas outlet aperture. The surface may be curved such that it extends from the polymer output bore, curves away from the polymer output bore and toward the gas output bore to transition to the gas output bore.

The transition surface between be symmetric about an axis between the polymer output aperture and the gas output aperture. The transition surface may be asymmetric about an axis between the polymer output aperture and the gas output aperture.

In an exemplary embodiment, the polymer output aperture and the gas output aperture can be any shape and/or dimension. Conventionally, a smaller aperture was required to obtain smaller fiber dimensions. However, such restriction limited the output rate of the system, and thereby limited overall scalability. Exemplary embodiments may achieve the desired fiber dimensions without having to limit aperture size. In addition, such limitations interfere with the potential doping or impregnation of various chemicals in the nanofiber. For some applications, impregnation of various chemicals into the nanofiber is extremely useful. For example, for filtration applications, the addition of a chemical powder to bond lead, cadmium, or other heavy metal may be useful. Other target materials, such as, for example, other toxic or organic materials, may also be desirable besides heavy metals for filtration applications or other applications. However, conventional systems had limited orifice size that were too small to accommodate easy passage of doping materials. These systems therefore can clog easily. Accordingly, exemplary embodiments may include apertures without a nozzle aperture size restriction. Therefore, exemplary embodiments may include apertures having dimensions (such as width, height, and/or diameter) of 0.5 to 20 millimeters and upwards of 3 meters in a cross dimension of a rectangular aperture.

Figure 5:
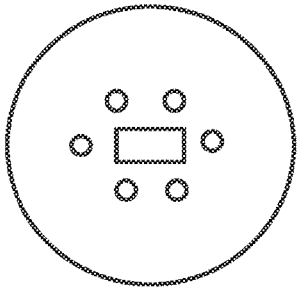
FIG. 5 illustrates an exemplary front face of an output according to embodiments described herein.

In an exemplary embodiment, the polymer output aperture and/or gas output aperture are circular, oval, ovoid, elliptical, square, rectangular, polygonal, non-geometric, and combinations thereof. For example, FIG. 5 illustrates an exemplary front face of a nozzle including different combinations of output apertures according to embodiments described herein. An exemplary transition surface may be between the polymer output aperture and the gas output aperture. The shape of the transition surface may circumferentially surround an aperture and define a perimeter of the aperture, or may only extend partially around the aperture. In an exemplary embodiment, the transition surface is only between the polymer output and the gas output apertures. In an exemplary embodiment, the polymer output and/or gas outlet includes a rectangular shaped output orifice. The long axis of the polymer output and the gas outlet may be aligned. The rectangular polymer output port may be used to expel a film-like stream of melted polymer. Such a configuration may permit higher output volumes and/or reduce energy consumption.

In addition to a gas aperture below the polymer aperture, the nozzle may include one or more other gas apertures for controlling a gas stream from the system. For example, a gas aperture may be positioned above the polymer aperture to control any back splatter or flow profile created by the gas flow capturing the polymer flow. For example, if the gas flow is angled relative to a desired flow path, one or more other gas flows may be introduced to redirect the gas flow and define a desired gas flow path for the polymer output/gas stream. In an exemplary embodiment, a plurality of gas output apertures are adjacent one or more polymer output apertures. Although embodiments described herein may include at least one gas aperture below the polymer aperture, one or more polymer apertures may be positioned below the gas aperture, such as shown in FIG. 2. In some cases, there may not be a gas aperture below the polymer aperture. In these cases, the aerodynamic lifting force of the gas stream may be used to pull the polymer into the gas stream.

In an exemplary embodiment, the system does not include a heating mechanism directly to the gas before entering the nozzle. The nozzle itself may be heated to keep the polymer at a desired temperature. However, the output gas is not pre-heated. Despite minimal heating at the nozzle itself, the gas stream exits the nozzle under 200° C. Exemplary embodiments, such as for a polymer of polypropylene, include an output gas stream of between 20 and 60° C. at a distance of approximately 15 centimeters from the nozzle, depending on the ambient air temperature. The gas stream may be pressurized at approximately 80 to 5,000 pounds per square inch (psi) for controlling quality and size of the fibers to be produced. For example, 80 to 100 psi may be used, which may vary from 30 to above 100 psi. The gas stream may be an inert gas. The gas stream may comprise any combination of gases, such as, for example, nitrogen, argon, neon, air, helium, steam, carbon dioxide, hydrocarbon gas, and combinations thereof.

Exemplary heating elements described herein may be in thermal conductive contact with portions of the apparatus, such as, for example, the polymer feed, the extruder driver mechanism, the nozzle, and combinations thereof. Exemplary heating elements may include a coiled heating element, a film heating element, induction heating element, cartridge heating element, resistive heating element, other heating mechanism, and combinations thereof. The heating element may be coupled to a power source, temperature controller, temperature sensor, temperature display, feedback loop, and any combination thereof to power and/or control the temperature of the polymer. The desired temperature of the polymer may depend on the polymer, such as a melting point of the polymer. For example, a temperature of 195° C. may be targeted for polypropylene.

Exemplary embodiments may be used with thermal melted polymers as well as solvent dissolved polymers. The polymer may include, for example, poly-tetraflouroethelene (PTFE), polyethersulfone (PES), poly-acrylonitrile, polyolefins, cellulose acetates, cellulose nitrites, fluoropolymers, polyamides, polyimides, polystyrene, polysulfaone, polyarylamides (e.g., poly(hexamethylene adipamide), poly(m-caproamide) and poly(hexamethylene sebacamide)), polybutadienes, polybutenes, polycarbonates, polyesters (e.g., poly(methymethacrylate) and poly(ethyleneterephthalate)), polyethelene, polypropylenes, polyvinyls (e.g., polystyrene), polyvinyl acetates, polyurethanes, polyvinyl alcohol, acrylates, methacrylates, polyvinylidence chlorides, silicones, styrenes, ethylene-methacrylic acid copolymers, ethylene-vinyl acetate copolymers, polyvinylacertate-methacrylic copolymers, polyaramides, polymethylmethacrylates, C—C polyolefins, high density polyethylene, and any combinations thereof.

Fibers produced by exemplary embodiments described herein may include fiber diameters of between 1 nanometer and 100 microns, and can be used to produce any individual range of fibers, such as, for example, 1 nanometer to 1 micron, 1 nanometer to 500 nanometers, 1 nanometer to 50 nanometers, 10 nanometers to 50 nanometers, 50 nanometers to 500 nanometers. Although embodiments described herein are for creating nanofibers, exemplary embodiments may also be used to create larger fibers such as microfibers, or fibers up to 1 millimeter.

Exemplary embodiments may be used to support higher polymer throughput rates to support mass production of reduced diameter, non-woven, polymer fibers. Exemplary throughput rates may be approximately 1 to 5,000 grams per minute per polymer output orifice.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

As used herein, the terms "about," "substantially," or "approximately" for any numerical values, ranges, shapes, distances, relative relationships, etc. indicate a suitable dimensional tolerance that allows the part or collection of components to function for its intended purpose as described herein. Numerical ranges may also be provided herein. Unless otherwise indicated, each range is intended to include the endpoints, and any quantity within the provided range. Therefore, a range of 2-4, includes 2, 3, 4, and any subdivision between 2 and 4, such as 2.1, 2.01, and 2.001. The range also encompasses any combination of ranges, such that 2-4 includes 2-3 and 3-4.

The invention claimed is:

1. A method of forming non-woven fibers, comprising:

melting a substance in an extruder;

dispensing the melted substance through a first aperture in a nozzle on an end of the extruder at atmospheric pressure;

outputting a gas stream through a second aperture in the nozzle proximate the melted substance, the gas stream outputted having a temperature between 20 and 60° C.;

contacting the gas stream to the melted substance, wherein the gas stream contacts the melted substance without pre-heating the gas stream; and generating from the melted substance through the gas stream non-woven fibers of diameters between 1 nanometer and 1 micron by flowing the melted substance on the nozzle between the first aperture and the second aperture such that the melted substance is supplied to the gas stream under a force of gravity only.

2. The method of claim 1, wherein the gas stream is output from the nozzle having a temperature between 20 and 60° C. at a distance 15 centimeters from a front face of the nozzle.

3. The method of claim 1, wherein the generating step comprises generating the non-woven fibers having a diameter of 1 nanometer to 500 nanometers.

4. The method of claim 1, wherein the flowing of the melted substance is along a surface of the nozzle between the first aperture and the second aperture.

5. The method of claim 4, wherein the output gas stream is output at a direction approximately perpendicular to the surface of the nozzle between the first aperture and second aperture along the direction of flow of the melted substance.

6. The method of claim 5, wherein the generating step comprises generating the non-woven fibers having a diameter of 1 nanometer to 500 nanometers.

7. The method of claim 6, wherein the first aperture for dispensing the melted substance is positioned in a central region between a plurality of apertures, including the second aperture, for outputting the gas stream.

* * * * *